United States Patent [19]

Morrow, Sr. et al.

[11] 4,081,081

[45] Mar. 28, 1978

[54] DEMOUNTABLE GANTRY, BOOM HOIST AND COUNTERWEIGHT

[75] Inventors: James G. Morrow, Sr.; David J. Pech; Jay Borstad, all of Manitowoc, Wis.

[73] Assignee: The Manitowoc Company, Inc., Manitowoc, Wis.

[21] Appl. No.: 735,812

[22] Filed: Oct. 26, 1976

Related U.S. Application Data

[63] Continuation-in-part of Ser. No. 625,119, Oct. 23, 1975, abandoned.

[51] Int. Cl.[2] ..... B66C 23/72

[52] U.S. Cl. ..... 212/49; 212/59 R

[58] Field of Search ..... 212/48, 49, 59 R, 58 R; 214/142, 145 A

[56] References Cited

U.S. PATENT DOCUMENTS

| | | | |
|---|---|---|---|
| 3,204,793 | 9/1965 | Lane | 212/145 A |
| 3,278,045 | 10/1966 | Potter | 212/49 |
| 3,891,095 | 6/1975 | Symmank | 212/48 |

*Primary Examiner*—Lawrence J. Oresky

*Attorney, Agent, or Firm*—Leydig, Voit, Osann, Mayer & Holt, Ltd.

[57] ABSTRACT

The back hitch assembly for a lift crane includes hydraulic cylinders for raising the pivotally mounted gantry members and masts. Counterweight lift links are connected between the gantry and the counterweight and the back hitch cylinders may be used to mount and demount the counterweight and the boom hoist winch. The masts, gantry members and back hitch cylinders may be folded back over the bed of the crane for low profile transport or they may be demounted to further reduce weight.

6 Claims, 5 Drawing Figures

10
12
13
14
15
16
17
18
19
20
21
22
23
24
25
26
27
28
29
30
31
32
33
35
36
37
40
41
42
43
44
45
46
47
48
49
70
71

5
36
36a
34a
34
72
72a
71
32
76
75
77
67
73
74
73a
63
68
69
5
66
66a 36
34
72
72a
71
75
76
74
73
73a
71

DEMOUNTABLE GANTRY, BOOM HOIST AND COUNTERWEIGHT

This application is a continuation-in-part of our copending application Ser. No. 625,119 filed Oct. 23, 1975, now abandoned.

The present invention relates generally to load handling devices and more particularly concerns a demountable, gantry, back hitch and counterweight assembly for lift cranes.

One of the difficulties with very large load handling devices, such as mobile lift cranes, is that due to their size they must be at least partially disassembled for shipment and transport from one job site to another. This is particularly true with respect to the counterweight assembly of large lift cranes. Typically the weight of such counterweights is so great that they must be removed so the crane does not exceed the load limitations of the transporting carrier when the crane is moved from one job site to another. On very large cranes it may also be necessary to remove additional components such as the back hitch, gantry members, masts and boom hoist mechanism to reduce the crane's weight to within acceptable limits. In the past, it has generally been necessary to use a second lift crane when assembling or disassembling the first one.

Accordingly, it is the primary aim of the present invention to provide a mobile lift crane with a demountable gantry, back hitch and counterweight assembly which facilitates the assembly and disassembly of those components as well as the masts and boom hoist mechanism with respect to the crane upper works. A more detailed object is to provide a back hitch assembly which may be folded back over the rear of the crane upper works to decrease the crane's profile for self-propelled movement from one location to another and which may also be employed for mounting and demounting the counterweight and boom hoist mechanism.

It is a more specific object to provide a folding back hitch assembly for a lift crane with a hydraulic cylinder arrangement effective to initially raise the pivotally mounted gantry and masts of such a crane and to provide the lifting force necessary for mounting and demounting the counterweight and boom hoist mechanism.

Yet another object of the invention is to provide a counterweight assembly with hydraulically actuated lock pins for securing the counterweight to the bed of the crane.

A further object is to provide the counterweight lift links with adjusting means to accommodate changes in the center of gravity of the counterweight and thus assure precise alignment of the openings in the crane and counterweight elements through which the lock pins are inserted and withdrawn.

These and other objects and advantages of the invention will become apparent upon reading the following detailed description and upon reference to the drawings in which:

FIG. 1 is a side elevation of a lift crane embodying the demountable, gantry, back hitch and counterweight of the present invention;

FIG. 2 is an enlarged, fragmentary side elevation of the rotatable bed of the lift crane shown in FIG. 1 illustrating: in substantially horizontal dash lines, the back hitch, gantry and mast in folded transport position; in solid lines, the mast raised to its initial erection position by the back hitch and gantry mechanism; and, in substantially vertical broken lines, the mast raised to a subsequent position by its self-erecting cylinders;

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Figure 1:
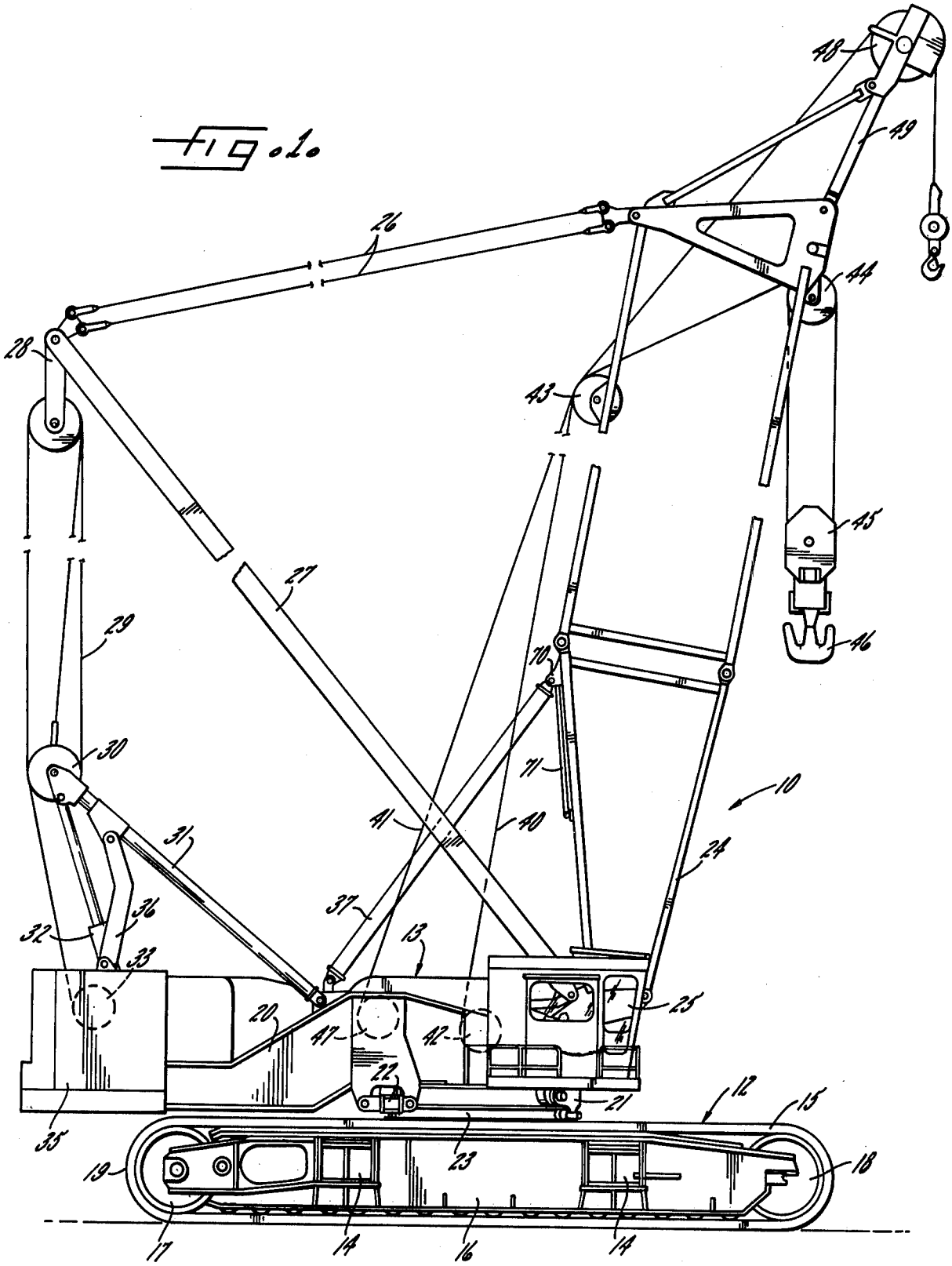

Turning now to the drawings, there is shown in FIG. 1 a load handling device in the form of a lift crane assembly 10, with which the present invention is associated. The crane assembly 10 includes lower works 12 and upper works 13. The lower works 12 includes a pair of transverse beams 14 the ends of which are supported by a pair of traction assemblies 15 (only one of which is shown). Each traction assembly 15 includes side frames 16 which support a drive sprocket 17 and an idler sprocket 18 around which a crawler tread 19 runs.

The upper works 13 of the crane assembly 10 includes a rotatable bed 20 supported by front and rear roller assemblies 21, 22 which engage a ring gear and roller path 23 on the lower works 12. A working boom 24 is pivotally connected to the forward end of the rotatable bed 20 by a boom carrier 25 in the form of a pair of laterally spaced butt plates (only one of which is shown). The boom 24 is supported by two pairs of laterally spaced pendants 26 (only one pair of which is shown) extending rearwardly to the upper ends of laterally spaced masts 27, each of which carries an equalizer assembly 28 round which a boom hoist line 29 runs. Another equalizer assembly 30 is carried by the upper end of a pair of pivotally mounted gantry members 31 which are raised and held in position by a back hitch assembly in the form of a pair of hydraulic cylinders 32 (only one of which is shown). Preferably, each of the boom hoist lines 29 form a multi-part line between the equalizer assemblies 28, 30 and the other end of each line is wound on a drum of a dual drum boom hoist 33 at the rear of the upper works 13. In order to accommodate heavy loads, the crane 10 carries, at the rear of the rotatable bed 20, a large counterweight 35 which is coupled to the gantry member 31 by toggle links 34 and left links 36.

As will be appreciated by those skilled in the art, the foregoing components of the crane 10, although illustrated somewhat schematically, are shown in FIG. 1 in substantially their normal operating positions. To prevent overcentering of the boom 25, the upper works 13 also carries automatic, cushioned boom stops 37. The illustrated crane 10 is also equipped with two lift lines 40 and 41. The front lift line 40 is wound on a drum 42 and extends over a sheave 43 on the rear side of the boom 25 and then makes a double reach between upper and lower equalizer assemblies 44, 45, respectively, carried by the boom and a main hook assembly 46. The rear lift line 41 is wound on another drum 47 and extends over another sheave 43 and then over an upper pulley assembly 48 mounted on the end of a boom extension 49. It will also be understood that the upper works 13 carries a suitable power source, such as a diesel engine (not shown) and appropriate variable control power transmission means for the major functions of the crane including hydraulic pump means and controls (not shown) for the back hitch cylinders 32.

Figure 2:
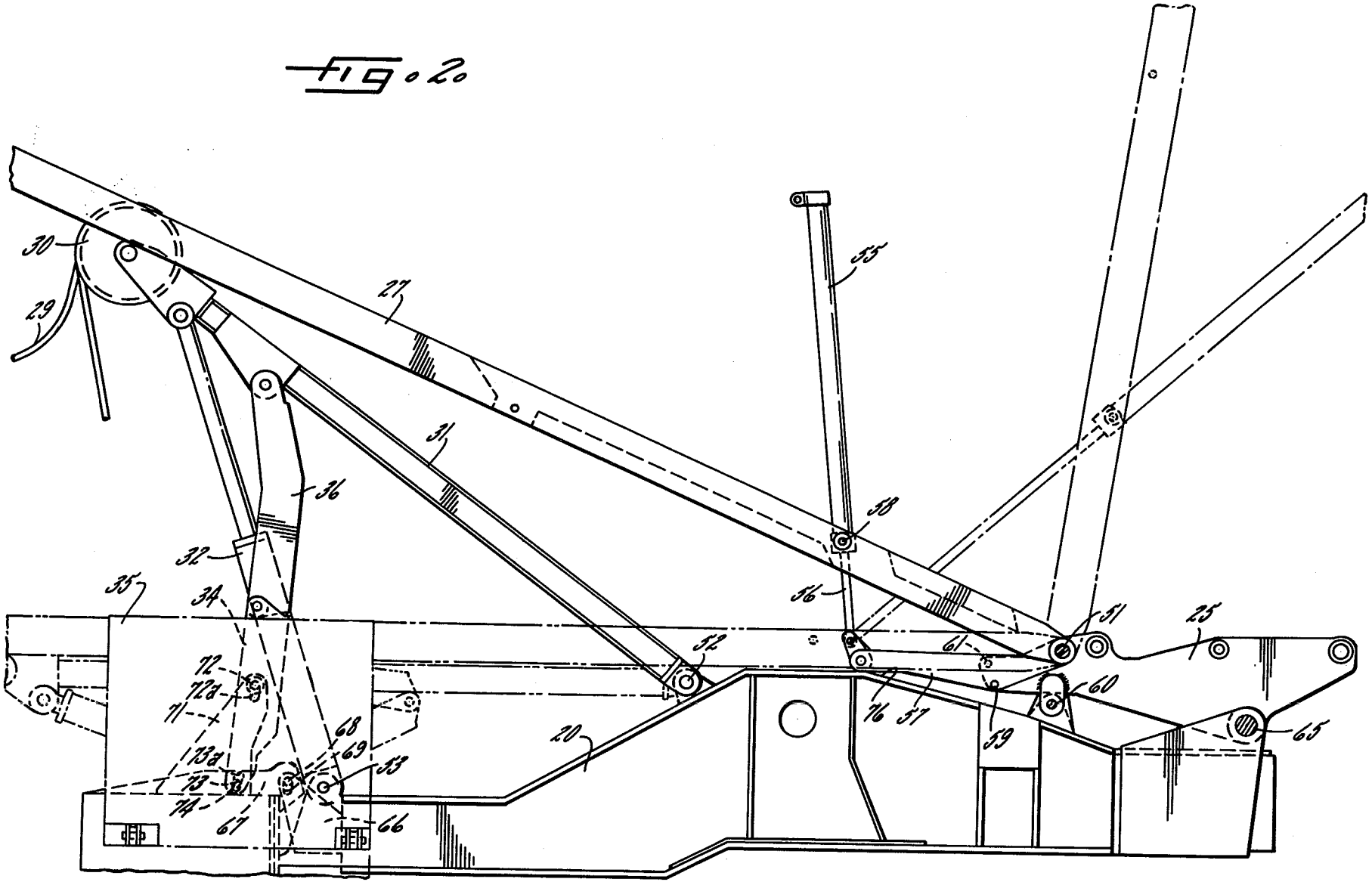

In accordance with the present invention, the boom 24 may be detached from carrier 25 and the masts 27, gantry members 31, back hitch cylinders 32 and counterweight links 34 and 36 may be folded down to substantially decrease the profile of the crane 10, as shown in the lower dash lines of FIGS. 2, when the crane is moved from one job site to another. To this end, the masts 27 are pivotally mounted at the rear of the boom carrier 25 by pins 51 and the gantry members 31 and back hitch cylinders are pivotally mounted by pins 52 and 53 to lugs on the rotatable bed 20. The lift links 36 are connected to the counterweight 35 through toggle links 34 and as the back hitch cylinders 32 are lowered, the links 36 and 34 fold or toggle together as shown in the lower dash line illustration of FIG. 2.

To raise the masts 27 and gantry members 31 from their lowered transport position, the back hitch cylinders 32 are actuated. This unfolds the links 36 and 34 and raises the gantry members 31 and masts 27 to the position shown by solid lines in FIG. 2. This is the operating position (see FIG. 1) for the gantry members 31, back hitch cylinders 32 and counterweight links 36 and 34 but is only an intermediate position for the masts 27. For raising the masts from their intermediate position to a substantially vertical but somewhat forwardly inclined position, illustrated at the right in FIG. 2, a pair of self-storing mast cylinders 55 (only one of which is shown) are provided. The piston rod 56 of each cylinder 55 is pinned to the end of a lever arm 57 which extends rearwardly from the mast pivot pin 51 and the cylinders 55 are pivotally connected by the pins 58 to their respective masts 27.

When the masts 27 are raised to their intermediate position (solid line in FIG. 2) by the back hitch cylinders 32, the piston rods 56 of the mast cylinders 55 are extended and the mast cylinders swing into a substantially vertical position. By actuating the mast cylinders 55, the rods 56 are fully extended and the masts 27 are rotated to their slightly forwardly inclined position in FIG. 2. It will be understood, of course, that the upper ends of the mast 27 carry the equalizer assemblies 28 which are interconnected by the multi-part lines 29 to the gantry equalizer assemblies 30 and to the drums of the boom hoist winch 33. Further forward movement of the masts 27 is prevented by the fully extended mast cylinders 55 since the lever arms 57 are secured by pins 59 to the boom carrier 25 which, in turn, is pinned at 60 to a mounting ear on the rotating bed 20. By removing the pins 59 and paying out cables 29 from the boom hoist 33, the masts 27 are pivoted forwardly by their own weight about the pivots 51. At the same time the lever arms 57 are also rotated about the pivots 51 by the fully extended mast cylinders 55 to the position where the pins 59 may be reinserted in a pair of upper holes 61 located in the boom carrier butt plates 25.

Figure 5:
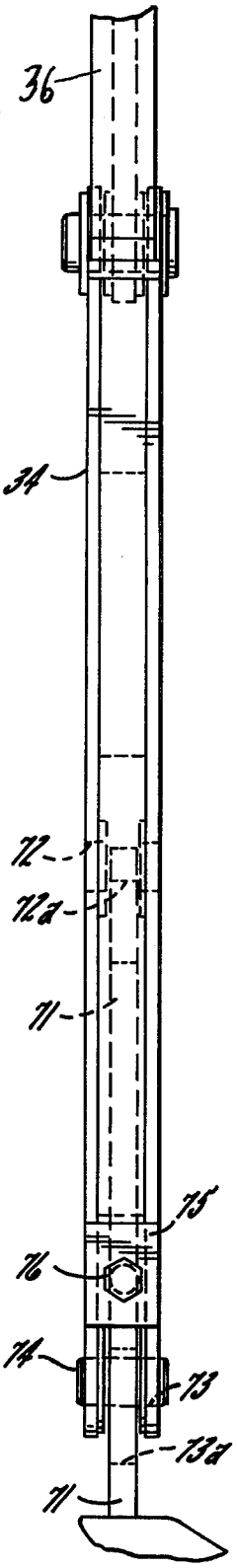

In order to attach the boom 24 to the carrier 25, the latter must be rotated upwardly and forwardly about its main pivot pins 65. Reference may be made to copending application Ser. No. 625,197, entitled Self-Erecting Mast and Boom, filed on Oct. 23, 1975, for a complete description of how the boom is attached. Briefly, this is accomplished by first removing pins 60 from the carrier 25 and paying out more cable 29 from the winch drums 33. The overhanging weight of the masts 27 then swings the masts 27 and the carrier 25 about the pivot 65 until the rear end of the carrier is raised about 30° from the horizontal. At this point, the mast cylinders 55 are then retracted, pulling the lever arms 57 upwardly substantially into alignment with the masts 27 as shown in dash lines in FIG. 5. As this takes place, the boom carrier 25 is rotated upwardly and forwardly about the pivot 65 and, the masts 27 are carried upwardly as the lever arms 57 are drawn up into alignment with the masts 27. The forward end of the masts 27 may now be rigged with a hoist line, such as 40, 41 which can be used to help position the boom 24 relative to the boom carrier 25 for insertion of support pins. In addition, the mast cylinders 55 can be actuated to extend or retract the piston rods 56 slightly and thus rotate the boom carrier 25 aligning the holes in the boom 24 and carrier 25 to facilitate insertion of the support pins.

Figure 3A:
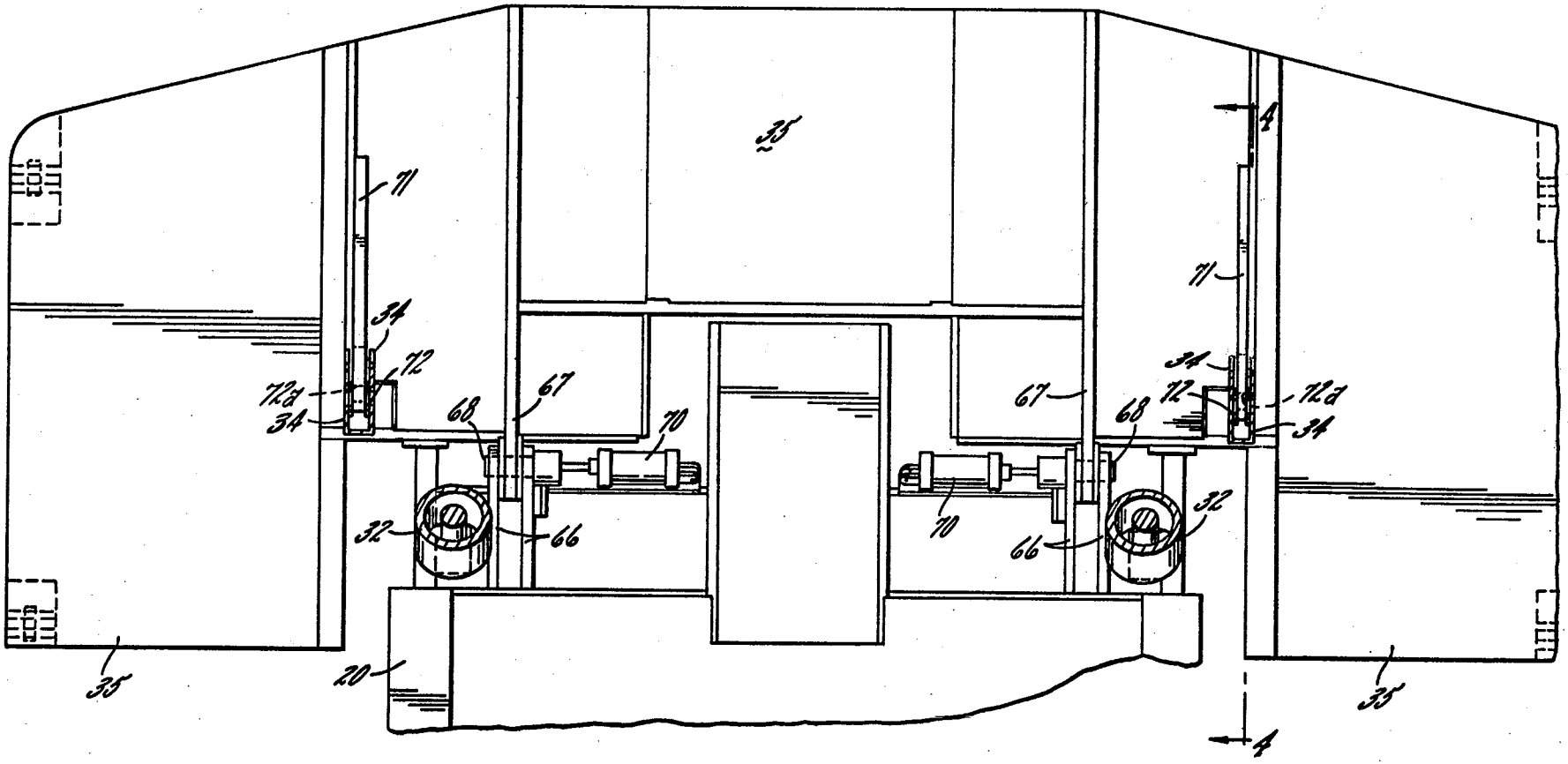
FIG. 3 is an enlarged, fragmentary plan view, partially in section, of the counterweight assembly and hydraulically actuated lock pins.

Pursuant to the present invention, the back hitch cylinders 32 are also employed to mount and demount the counterweight assembly 35. Referring now to FIGS. 2 and 3, the counterweight assembly 35 is normally carried at the rear of the rotatable bed 20 by pairs of mounting plates 66. A vertical web 67 of the counterweight 35 extends between each pair of plates 66 and a lock pin 68 is inserted through aligned apertures in the plates 66 and an elongated slot 69 in the counterweight webs 67. Preferably, the lock pins 68 are inserted and withdrawn by fluid actuators 70 secured to the bed 20. In the position shown in FIG. 2, the pins 68 engage the top of the slots 69 and the counterweight swings against the projecting ends **66*a* of the mounting plates 66 at the rear end of the rotatable bed 20**.

The toggle links 34 are also connected to lift arms 71 of the counterweight assembly. As shown in FIG. 2, the toggle links 34 have upper and lower circular apertures 72 and 73 adapted to receive a lift pin 74 in either a companion upper or lower slot **72*a* and 73*a* in the lift arms 71. In the operating position, the lift pin 74 is inserted in the lower aperture 73 and slot 73*a* and the back hitch cylinders 32 are fully extended. When a heavy load is supported by the boom 24, the pendants 26, the boom hoist lines 29 and the cylinders 32 are tensioned and apply a lifting force on the rotatable bed 20**.

When it is desired to demount the counterweight assembly 35, the upper works 13 is generally rotated so the boom 24 projects laterally over one of the crawler assemblies 15 and the boom is then lowered to rest on the ground or some other support. The masts 27 are also lowered (clockwise in FIG. 1) far enough that there is an appreciable amount of slacks in the pendants 26. This relieves most of the tension on the back hitch cylinders 32 and the lift pins 74 may be removed from the lower aperture 73 and slots **73*a*. Retracting the back hitch cylinders 32 slightly permits the lift pins 74 to be reinserted in the upper aperture 72 and slots 72*a***.

By pressurizing the back hitch cylinders 32, the counterweight 35 may be lifted and lock pins 68 withdrawn by the actuators 70. The counterweight 35 may then be lowered to the ground by retracting the cylinders 32 and the links 36 may be unpinned at their upper end from the gantry members 31 and folded into the center portion of the counterweight assembly.

To mount the counterweight assembly on the rotatable bed 20 substantially the reverse of the demounting procedure is followed. Thus, the pins 74 are inserted in the upper aperture 72 and slots 72*a* and the cylinders 32 are energized to lift the counterweight assembly. It will be appreciated that the counterweight assembly 35 has a substantial mass, e.g. on the order of 50 tons or more, and that it may be made up of various box sections filled with scrap iron, concrete, or the like. Therefore, as the counterweight is lifted, it may tend to tilt somewhat if the center of gravity is not located directly below the center of the lift pins 74 when they are inserted in the upper aperture 72 and slots 72*a*.

Figure 4:
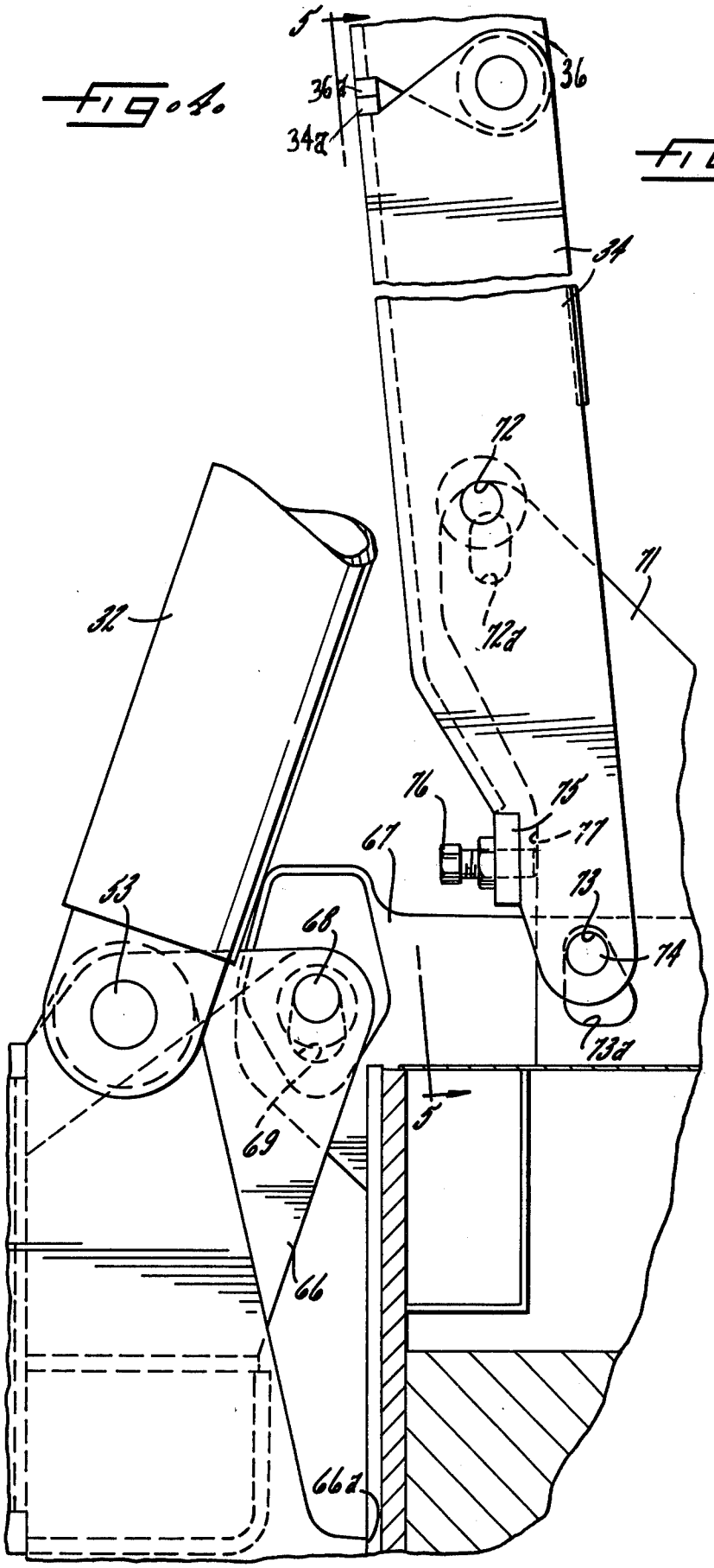
FIG. 4 is an enlarged, fragmentary section taken substantially along line 4—4 in FIG. 3; and, FIG. 5 is a fragmentary end view of one of the lift links substantially as seen along line 5—5 in FIG. 4.

In accordance with a further aspect of the present invention, the slots 72*a* are purposely located slightly ahead of the anticipated center of gravity of the counterweight assembly and means are provided for resisting rearward tilting of the counterweight as it is lifted (or lowered) into place. As shown in FIG. 4, the lower end of each of the toggle links 34 is provided with a cross plate 75 having a threaded aperture through which an adjustment bolt 76 is screwed so as to engage the front edge 77 of the lift arm 71. It will be appreciated, of course, that as the counterweight assembly 35 is being lifted, the links 34, 36 are extended to their straight position with their intermediate end portions 34*a* and 36*a* butted together adjacent the front edges thereof. (see FIG. 4) Thus, with the bolts 76 engaging the edges 77 of the lift arms 71, the tendency of the counterweight assembly to tilt slightly rearwardly about the pins 74 operates to maintain the links 34, 36 in rigid abutting relation. Once the counterweight has been raised to the proper height, the bolts 76 can be screwed in or out, as necessary, in order to bring the slot 69 into precise alignment with the apertures in the mounting plates 66 so that the lock pins 68 may be inserted by operation of the fluid actuators 70.

Once the bolts 76 have been properly adjusted for a given counterweight assembly 35, the counterweight may be mounted and demounted without further adjustments being made. However, if the center of gravity of the counterweight assembly is altered, such as by adding or removing certain items of counterweight, the bolts 76 may be adjusted slightly to compensate for the shift in the center of gravity.

The back hitch cylinders 32 may also be employed in a similar manner to lift and lower the boom hoist winch 33 and for this purpose suitable lifting ears (not shown) are provided on the winch 33. When the boom hoist 33 is removed, the upper and lower equalizer assemblies 28 and 30 may also be unpinned from the masts 27 and gantry members 31, respectively, thus making it unnecessary to unreeve the boom hoist lines 29 from the equalizer assemblies or the winch drums. It will also be appreciated that the masts 27, gantry members 31 and even the back hitch cylinders 32 may be unpinned and removed from the upper works 13 if it is desired to further decrease the weight or the overall length of the rotatable bed 20.

Alternatively, if it is only necessary to reduce the height of the crane for clearance purposes, the masts 27, gantry members 31, cylinders 32 and links 36, 34 may be simply folded back and nested between the sides of the counterweight 35 as shown in the lower dash line portion of FIG. 2. Preferably, the counterweight assembly 35 is substantially U-shaped as viewed from both above and from the rear and is of the segmented or built-up type such that the sides and/or the back can be unpinned and removed from the base if desired.

We claim as our invention:

1. A demountable counterweight and back hitch assembly for a lift crane having a supporting bed with horizontally apertured mounting plates on the rear end thereof, a gantry pivotally mounted on the bed and a hydraulic cylinder connected between the rear end of the bed and the free end of the gantry, comprising, in combination, a counterweight having vertical web means with horizontal apertures therein for registry with said mounting plate apertures, locking pins for insertion through said apertures, linkage means interconnecting the counterweight and gantry for lifting the counterweight when the hydraulic cylinder is extended, said linkage means including a lift arm on the counterweight pinned forward of the center of gravity of the counterweight to a toggle link which is, in turn, pinned to a lift link connected to the gantry, said toggle link and lift link having intermediate end portions butted together adjacent the front edges thereof when the counterweight is being lifted, and adjusting means interposed between the toggle link and the front edge of the lift arm to prevent tipping of the counterweight as it is lifted, to maintain the toggle link and lift link in abutting relation and to facilitate registry of said apertures in said web and mounting plates.

2. An assembly as defined in claim 1 wherein said lift link and said toggle link are collapsible rearwardly when said cylinder is retracted and said gantry lowered.

3. An assembly as defined in claim 1 including a laterally spaced pair of said cylinders and said linkage means includes a laterally spaced pair of articulated toggle links connected to a pair of counterweight lift arms.

4. An assembly as defined in claim 3 wherein said toggle links are normally connected to said counterweight lift arms in a first position during crane lifting operations and said toggle links are selectively connected to said counterweight lift arms in a second position during mounting and demounting said counterweight with respect to the bed.

5. An assembly as defined in claim 4 wherein said first and second position connections include pins and slotted connector means for facilitating insertion and withdrawal of said pins as said toggle links are slightly raised and lowered by said cylinders.

6. An assembly as defined in claim 1 wherein the lower end of the toggle link is provided with a cross plate having a threaded aperture through which an adjustment bolt is screwed so as to engage the front edge of the lift arm.

* * * * *